United States Patent [19]

Dutra

[11] 4,154,339

[45] May 15, 1979

[54] LOOSE OBJECT HOLDER

[76] Inventor: Frank G. Dutra, 10046 Harvest Ave., Santa Fe Springs, Calif. 90670

[21] Appl. No.: 752,077

[22] Filed: Dec. 20, 1976

[51] Int. Cl.[2] ..... B65D 85/00; B65D 81/16; A63D 55/00

[52] U.S. Cl. ..... 206/315 R; 206/460; 206/523; 206/813; 273/157 R

[58] Field of Search ..... 206/450, 454, 455, 315, 206/216, 460, 813, 359, 523, 124, 132; 273/157 R; 217/56; 220/346, 345; 35/26

[56] References Cited

U.S. PATENT DOCUMENTS

| | | | |
|---|---|---|---|
| 2,566,500 | 9/1951 | Rose et al. | 217/56 |
| 2,692,673 | 10/1954 | Kruft | 206/359 |
| 2,842,262 | 7/1958 | Wismer | 206/216 |
| 3,225,913 | 12/1965 | Lee | 206/534 |
| 3,504,915 | 4/1970 | Walker | 206/315 |
| 3,606,338 | 9/1971 | Cannata | 273/157 R |
| 3,792,668 | 2/1974 | Ward | 273/157 R |

FOREIGN PATENT DOCUMENTS

| | | | |
|---|---|---|---|
| 436076 | 11/1967 | Switzerland | 273/157 R |

*Primary Examiner*—William T. Dixson, Jr.
*Attorney, Agent, or Firm*—Ronald L. Juniper

[57] ABSTRACT

A container adapted to hold loose articles in place by securing them against a backing structure by means of a specially fitted resilient removable lid.

9 Claims, 13 Drawing Figures

LOOSE OBJECT HOLDER

BACKGROUND OF THE INVENTION

A need for a holding means existed for people working on partially completed jigsaw puzzles, and other loose object articles, which had to be moved for storage. Often it was not practical to leave these loose pieces in a horizontal position since moving and storage was best accomplished when changed to a vertical position. However, the loose pieces tend to fall out of place when moved from a level position and there wasn't any readily available means which would satisfactorily hold them in place when so moved.

Thus, this invention was developed to provide a handy carrier and storage means for loose piece structures.

SUMMARY OF THE INVENTION

Briefly, a structure in accordance with this invention includes, as its basic form, a frame with a backing member mounted therein.

A lid is adapted to removably fit in said frame and is provided with a resilient surface positioned adjacent to the backing member when the lid is mounted in the frame.

The thickness, amount of resiliency and closeness of the lid to the backing member is determined by the height of the loose pieces to be held by the device since the pressure must be exerted against these loose pieces to hold them in place. The frame is provided with grooves in its internal peripheral edges which will hold the lid in place tightly enough to accomplish these purposes.

As further variations of this basic form means can be provided to, remove a completed loose piece structure so that it can be permanently glued. Further, the loose object holder can be made with a handle means for easy carrying in a vertical position. Also, additional lid-encased areas to facilitate multiple loose piece structure carrying can be provided.

DESCRIPTION OF PREFERRED EMBODIMENTS

Figure 1:
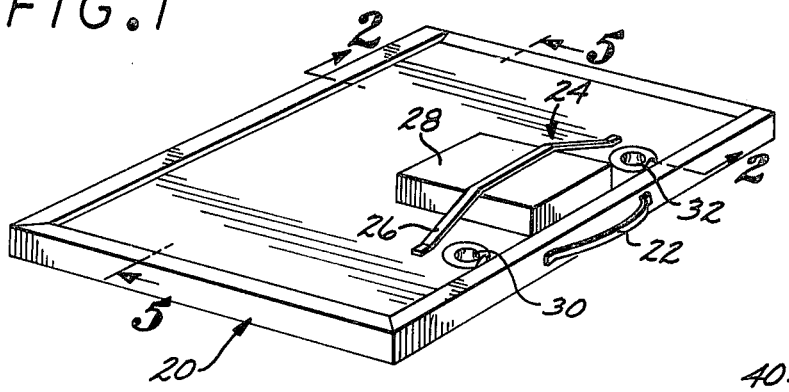
FIG. 1 is an isometric view of a loose object holder case in accordance with this invention.

The basic structure of this invention preferably takes the form of a case, as shown in FIG. 1, which has a rectangular peripheral frame 20 and a handle 22 on the top thereof for convenience in carrying.

A lid 24 is sized to matingly fit within the internal periphery of the frame 20. As shown the lid 24 includes, on its outer surface, a resilient strap 26, to hold a box 28 suitable for carrying loose articles therein. A pair of spaced grommet holes 30 are cut through lid 24 adjacent its top edge.

A flat backing member 34 is mounted within frame 20 to enclose the back side of the frame 20. As shown in FIGS. 2,4,5 and 6 its edges are secured in place within a bottom mating continuous groove 36A, 36B, 36C and 36D which is cut in the interior peripheral sides near the back of the members which form frame 20.

The lid 24 includes a resilient pad 40(which can be made of polyurethane foam) attached to its inner surface. The thickness and amount of resiliency of the pad 40 is predeterminedly designated generally to be in a plane parallel with backing member 34 when it is placed in position within the frame 20. Thus, as in FIGS. 2 and 4, it will firmly press against and hold in place a loose piece puzzle 42 resting on backing member 34.

In order to firmly and securely hold the lid 24 in the predesignated position sufficient to press against loose pieces enough to hold them in place matching grooves 44A and 44B are cut into the upper interior surfaces of opposing side members forming frame 20. The top surface of lid 24 is wide enough and stiff enough that its exterior opposing edges can be lodged within these grooves 44A and 44B so as to hold it firmly in place with its resilient pad 40 pressing against loose pieces therein as in FIG. 2. Preferably, this is a resilient bending, pressure-type fit(note the outward bowing in FIG. 2) so that the lid 24 can be lifted upward when bent to be released from grooves 44A and 44B when opening the case as in FIG. 4.

Figure 3:
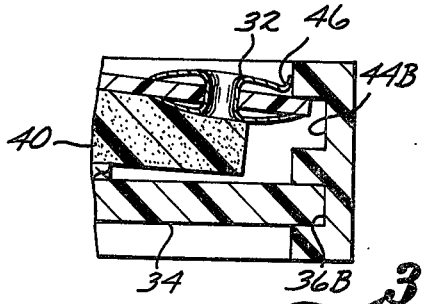
FIG. 3 is an enlarged fragmented view of the connecting lid and frame groove portion taken at 3 in FIG. 2.

The grommets 30 and 32 are positioned to facilitate locking the lid 24 in this predetermined pressure, resiliently snap-fitted position within the frame grooves. Thus, the grommets 30 and 32 are each provided with small locking edges 46 which bear against the adjacent interior frame member above groove 44B so as to limit the extent to which lid 24 is slid into groove 44B. This is best shown relative to grommet 32 in FIG. 3.

Figure 5:
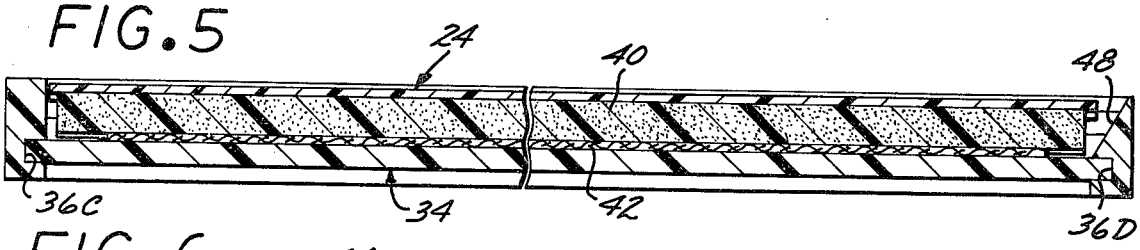
FIG. 5 is a cross-sectional view taken through 5—5 in FIG. 1.
Figure 6:
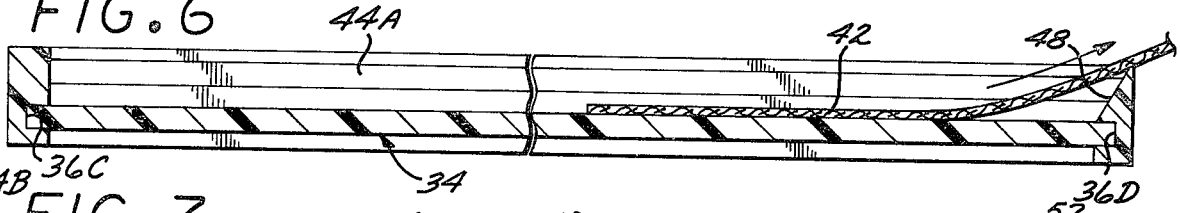
FIG. 6 is a cross-sectional view as in FIG. 5 showing the lid lifted and a completed loose piece article, such as a puzzle, being slid out over a frame edge.

In order to facilitate sliding a completed puzzle out of the case a side member of the frame 20, as shown in FIG. 5, is provided with an outwardly sloping interior wall surface 48. Thus, as shown in FIG. 6, when the lid is removed, a completed puzzle 42 can be gently slid out over this sloping surface 48.

Figure 7:
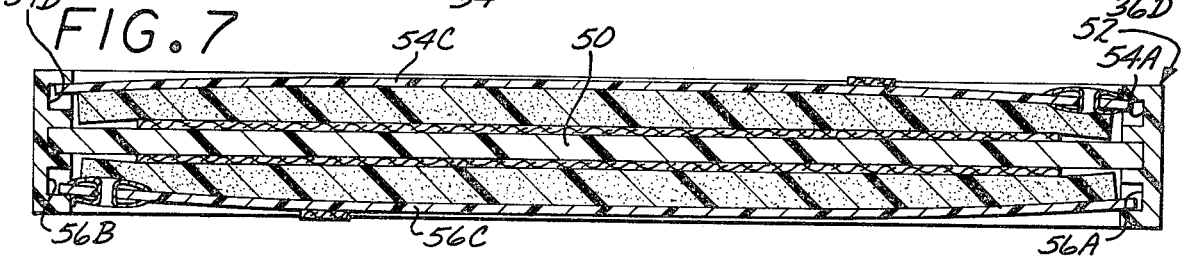
FIG. 7 is a cross-sectional view of a modified form of this invention which has two loose-piece article holding lids mounted in a frame having a centrally positioned backing member.

In FIG. 7 another version of this invention is shown wherein the backing member 50 is centered within the frame 52 and grooves 54A and 54B and grooves 56A and 56B, respectively, are cut into opposing members of frame 52 on both sides of backing member 50. Thus, a lid 54C can be mounted in grooves 54A and 54B and a lid 56A and 56B as hereinbefore described. Accordingly, a case with double capacity has been developed to carry two unfinished loose piece articles at the same time.

As shown in the foregoing examples of this invention a loose piece article, such as a partially completed puzzle, can be placed on a level backing member, the lid snapped into place, and then the holder raised to vertical position for carrying or storage while holding the loose pieces in place. With the double form shown in FIG. 7 loose piece articles are loaded one side at a time as described before raising to a vertical position.

Figure 2:
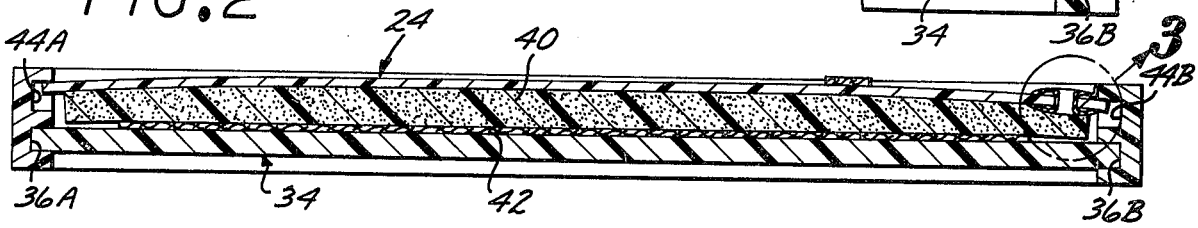
FIG. 2 is a cross-sectional view of the holder taken through 2—2 in FIG. 1.
Figure 4:
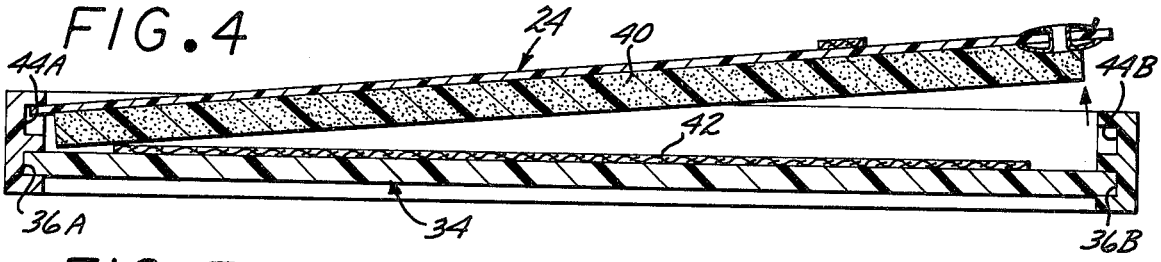
FIG. 4 is a cross-sectional view as in FIG. 2 showing the lid lifted from the frame.
Figure 8:
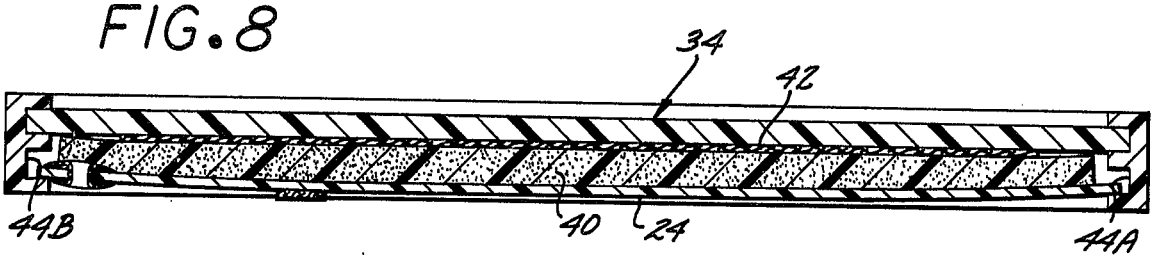
FIG. 8 is a cross-sectional view of a holder with a loose-piece article contained therein as in FIG. 2, but turned upside down.
Figure 9:
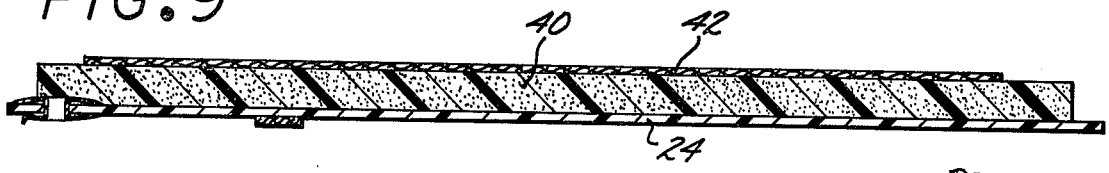
FIG. 9 is a cross-sectional view as in FIG. 8 with the lid and loose-piece article on top of the lid as it would appear when removed from the frame.
Figure 10:
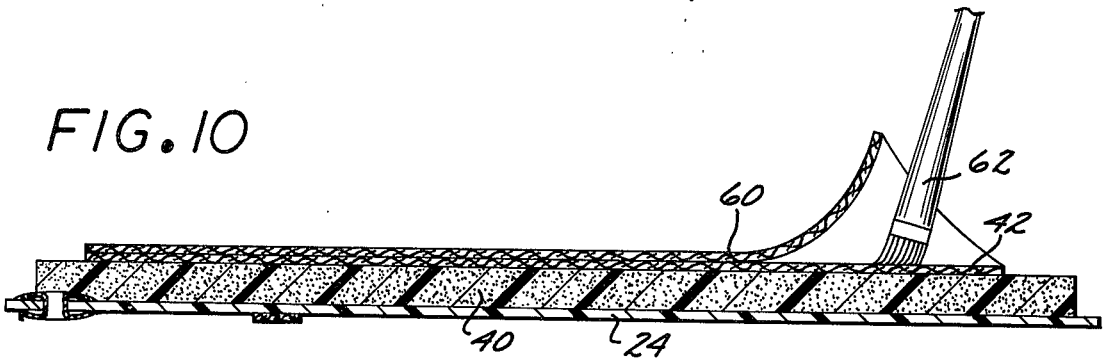
FIG. 10 is a cross-sectional view as in FIG. 9 showing the loose-piece article being glued to hold it intact when removed.

If it is desired to secure the loose pieces of a completed article, such as puzzle 42, together the single lid form of this invention, as shown in FIG. 2, is turned over as shown in FIG. 8 so that the lid 24 is now facing down. Then the lid 24 can be released from the attaching frame grooves 44A and 44B, as in FIG. 9 so that, for instance, the puzzle 42, now is resting exposed on top of the resilient portion 40 of lid 24. Thus, a cover sheet 60 can be laid on the exposed back of puzzle 42 and then glue applied, as shown with brush 62 in FIG. 10, to make a permanent back for the completed loose piece article.

Figure 11:
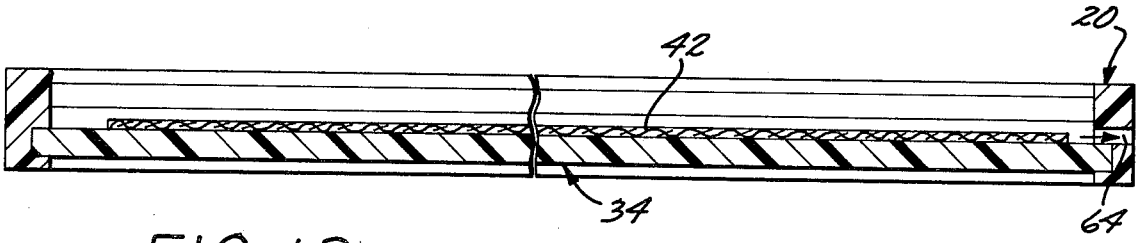
FIG. 11 shows a cross-sectional view of a loose-piece holder modification with a side-slot opening in the frame for horizontal removal of a loose-piece article.

Another form of this invention is shown in FIG. 11, which is similar to that previously described, except that an elongated slot 64 is provided in the side of one member of frame 20. This slot 64 is positioned in the same plane as that in which the loose piece article 42 rests. It is sized sufficiently large enough to allow an entire loose piece article 42, such as a completed puzzle, to pass through. This facilitates removal intact since the loose piece article 42 can be slid out sidewise without lifting.

Figure 12:
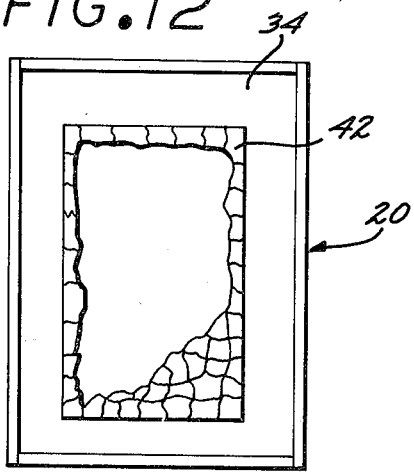
FIGS. 12 and 13 show, respectfully, top plan views with a partly completed puzzle and a grid design board on the back member.
Figure 13:
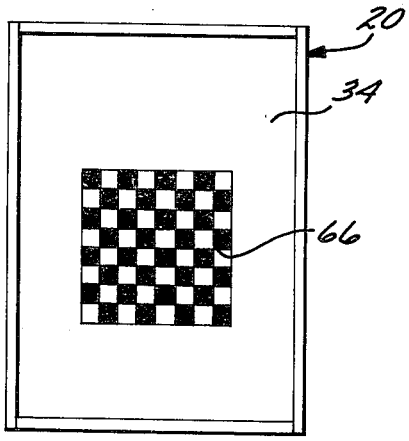

A top view of a partially completed puzzle, as the loose piece article 42, is shown centered on the backing member 34 within a rectangular frame 20 of a holder in accordance with this invention is illustrated in FIG. 12. When a lid 24 is snapped into position, as previously shown and described, the resilient portion 40 thereof thus presses firmly against the loose pieces of the puzzle. Then the holder can be turned to a vertical position for convenient carrying or storage with the puzzle pieces remaining in place until a person is ready to work on its again.

In still another modification of this invention a removable utility sheet 66 which can take the form of a grid, as shown, is positioned on the backing member 34. This sheet 66 can be used as a game board for loose piece articles, such as checkers, so that a set position of the game pieces can be maintained if it is necessary to move the game(with the lid secured in place as previously described) in a vertical position for carrying or storage.

Though particular forms of this invention are shown and described herein these are not meant as limitations on the coverage of this development which is intended to extend within the spirit of the claims to reasonable modifications thereof.

What is claimed is:

1. A container for holding a plurality of loose movable objects in position including:

a base surface upon which loose movable objects can be placed;

a lid cooperatively associated with said base surface, said lid having a resilient surface movable perpendicularly to a plane substantially parallel with and close to said base surface;

and frame means which includes predetermined grooved recesses within its internal peripheral edges which are adapted to receive external peripheral edges of said lid and said lid is sized to removably fit securely substantially flat under pressure within said frame;

said frame means provided for holding said edges tensioned fit relative to said base surface surface in a position where it can be moved and secured enough that loose movable objects on said base surface are firmly held vertically in position against predetermined pressure of the resilient surface of said lid.

2. A container as defined in claim 1 wherein grommets with bearing edge locking means positioned on said lid adjacent said grooved recesses, when mounted thereon, limit the movement and fit of said lid relative to said frame.

3. A container as defined in claim 1 wherein said frame is provided with a back member disposed to the rear of and parallel to the plane of said lid when held in said frame.

4. A container as defined in claim 3 wherein said frame is provided with peripheral grooves to receive said back member and said back member is removable from said frame.

5. A container as defined in claim 3 in combination with a removable utility sheet which is smaller than said lid and positioned on said back member.

6. A container as defined in claim 5 wherein an article made of completed loose piece objects is mounted on said utility sheet and bonded thereto so as to hold said loose objects in set position without fixed securing means.

7. A container as defined in claim 3 which includes a center-positioned back member within said frame, a pair of grooves in said frame to receive lids securely on both sides of said back member and a pair of lids adapted to be removably secured in position in each of said pair of grooves in said frame.

8. A container as defined in claim 7 wherein at least one of said inner frame walls is sloped outwardly enough to allow gradual sliding removal of a completed puzzle intact.

9. A container as defined in claim 3 which includes a slot extending through the side of said frame substantially in the same plane as a loose piece article to be held in said container wherein said slot is large enough that a completed loose piece article can be slid therethrough intact.

* * * * *